United States Patent [19]

Heidt et al.

[11] Patent Number: 5,000,682

[45] Date of Patent: Mar. 19, 1991

[54] VERTICAL THERMAL PROCESSOR FOR SEMICONDUCTOR WAFERS

[75] Inventors: Donald W. Heidt, Whitewright, Tex.; Steve Thompson, Kalispell, Mont.; Worm Lund, Seattle, Wash.; Raymon F. Thompson, Kalispell, Mont.; Larry M. Beasley, Austin, Tex.

[73] Assignee: Semitherm, Kalispell, Mont.

[21] Appl. No.: 467,937

[22] Filed: Jan. 22, 1990

[51] Int. Cl.[5] ..... F27D 3/12

[52] U.S. Cl. ..... 432/241; 432/6; 432/56; 432/205; 432/239; 432/242

[58] Field of Search ..... 432/6, 5, 56, 128, 205, 432/208, 239, 241, 242, 250, 253; 414/217

[56] References Cited

U.S. PATENT DOCUMENTS

| | | | |
|---|---|---|---|
| 4,610,628 | 9/1986 | Mizushina | 432/241 |
| 4,738,618 | 4/1988 | Massey et al. | 432/13 X |
| 4,758,157 | 7/1988 | Hailey | 432/121 |
| 4,790,750 | 12/1988 | Bourel et al. | 432/239 |
| 4,883,020 | 11/1989 | Kasai et al. | 118/728 X |
| 4,923,584 | 5/1990 | Bramhall, Jr. et al. | 204/298.25 |

*Primary Examiner*—Henry A. Bennet
*Assistant Examiner*—C. Kilner
*Attorney, Agent, or Firm*—Wells, St. John & Roberts

[57] ABSTRACT

Semiconductor wafers within a supporting vertical wafer tower are positioned within a vertical process chamber through a lower gate valve fixed to a supporting framework. The gate valve is sealed to a similar gate valve at the upper end of a movable load lock on the framework, within which the wafers are subjected to pre-treatment and post-treatment processes. Two load locks are alternately used in conjunction with the process chamber and a wafer loading station on the framework. In addition, a cleaning element is movably mounted on the framework for periodically maintaining the interior surfaces of the process tube within the process chamber.

27 Claims, 12 Drawing Sheets

FIG 6
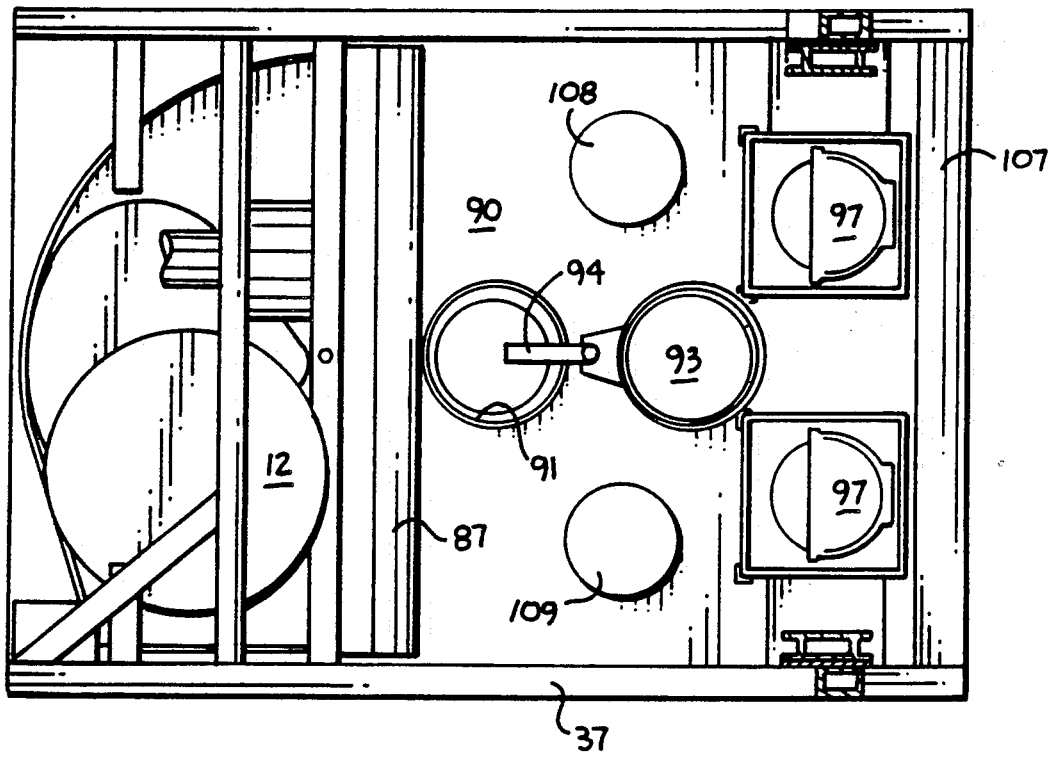
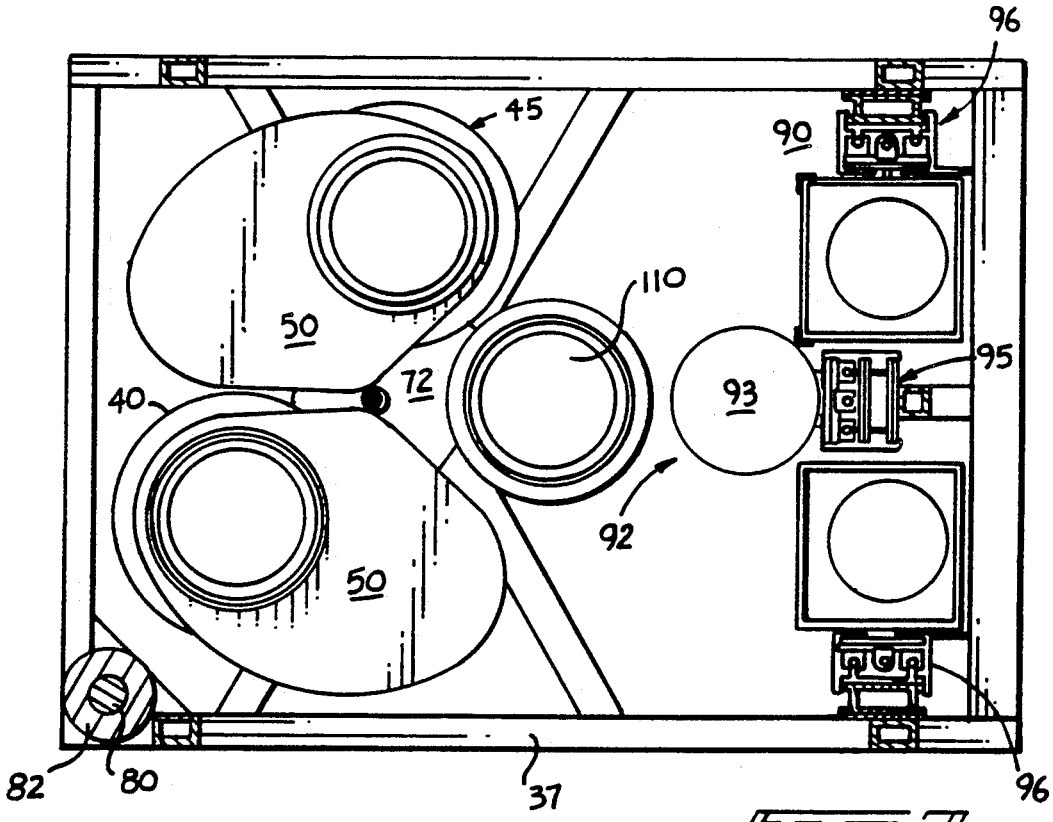
FIG 7

Fig 8
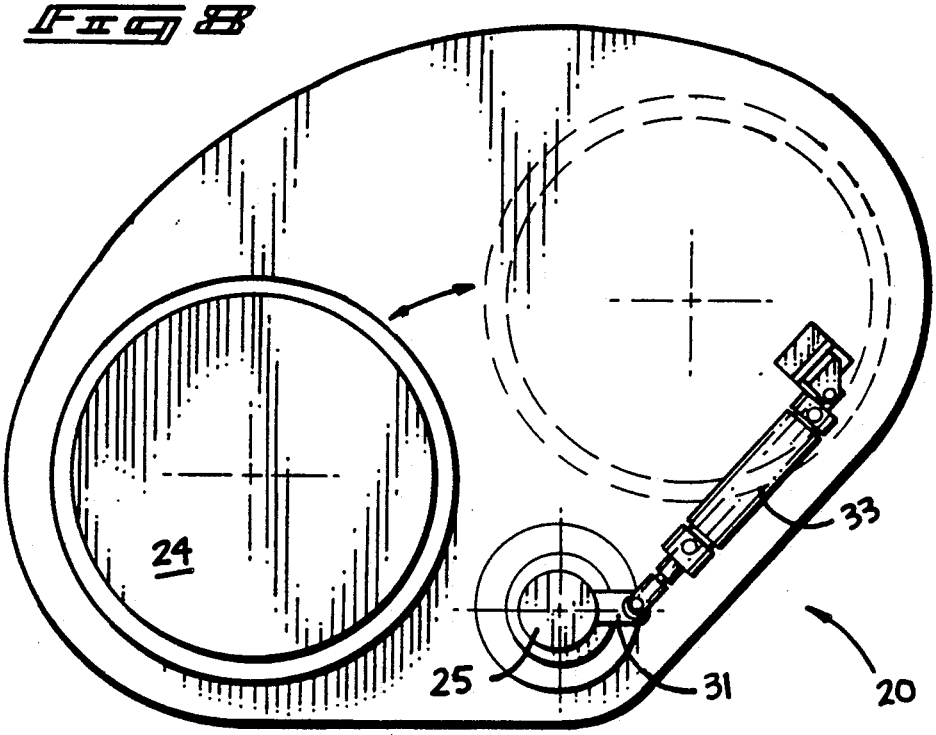
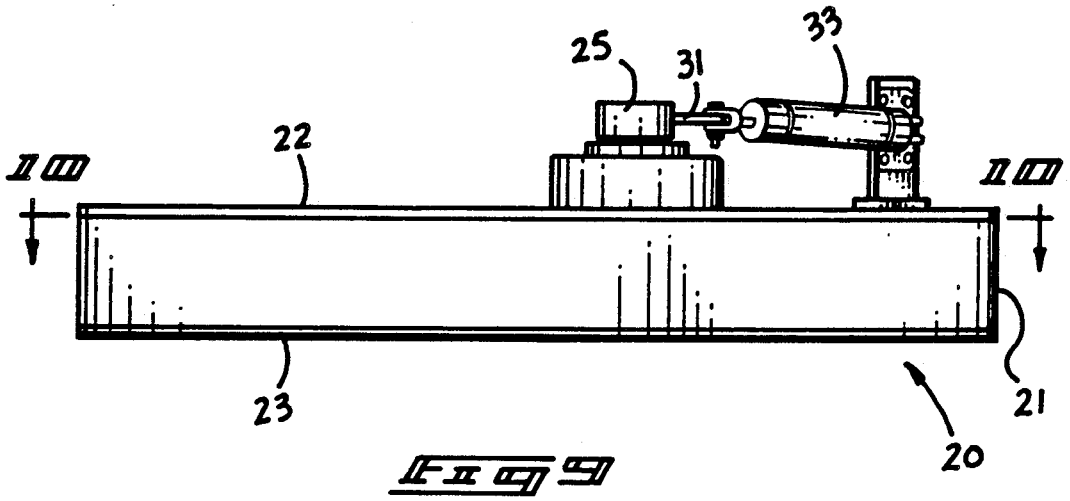
Fig 9

VERTICAL THERMAL PROCESSOR FOR SEMICONDUCTOR WAFERS

TECHNICAL FIELD

The equipment and method described below pertain to thermal processors for semiconductor wafers.

BACKGROUND OF THE INVENTION

This disclosure is directed to thermal and gaseous treatment of a plurality of wafers in batches under extremely clean production conditions. The disclosed apparatus and process have been designed to reduce the amount of wafer contamination, principally by particles released from reactor surfaces, during oxidation/diffusion and low pressure chemical vapor deposition (LPCVD) processes.

An alternate vertical furnace design that preceded this invention is illustrated in U.S. Pat. No. 4,738,618, issued to Robert G. Massey et al. on Apr. 19, 1988. This patent discloses a vertically oriented thermal processor, including a vertically adjustable furnace assembly and process tube. The process tube, in the form of a quartz bell jar, can be moved vertically up and down in the supporting framework in conjunction with the furnace assembly. Both the furnace assembly and process tube can also be moved up and down independently of one another.

One problem that has been identified with respect to certain applications of the thermal processor shown in U.S. Pat. No. 4,738,618 is the deposition of contaminants on the inner surface of the quartz process tube during certain treatment procedures. Such deposition in itself is not detrimental to the process, but the subsequent flaking off of the deposited materials during cooling and heating of the process tube surfaces releases particle contaminants to a degree that is unacceptable in some treatment systems.

The present invention arose from a need to physically separate the areas in which wafers are pre-heated and post-cooled from the areas in which gaseous or vapor treatments are conducted. Such treatments can then be efficiently carried out within a clean process chamber not subjected to heating and cooling across temperature ranges at which deposited materials can be released from the surrounding inert surfaces.

A further advantage of the disclosed equipment is the ability to transfer wafers between sealed chambers under vacuum conditions that confirm the integrity of the seals to prevent wafer contamination.

In addition, the vertical nature of the thermal processor reduces heat and energy losses by maintaining the process chamber at an elevated position relative to the load locks within which the wafers are heated and cooled.

BRIEF DESCRIPTION OF THE DRAWINGS

The preferred embodiment of the invention is illustrated in the accompanying drawings, in which:

FIG. 6 is a plan view taken along line 6—6 in FIG. 4;

FIG. 7 is a sectional view taken along line 7—7 in FIG. 4;

FIG. 8 is an exterior plan view of a gate valve assembly;

FIG. 9 is an elevational view of the gate valve assembly as seen from the front in FIG. 8;

DETAILED DESCRIPTION OF THE PREFERRED EMBODIMENT

Figures 1, 2, 2A, 2B, 3, 3A, 3B:
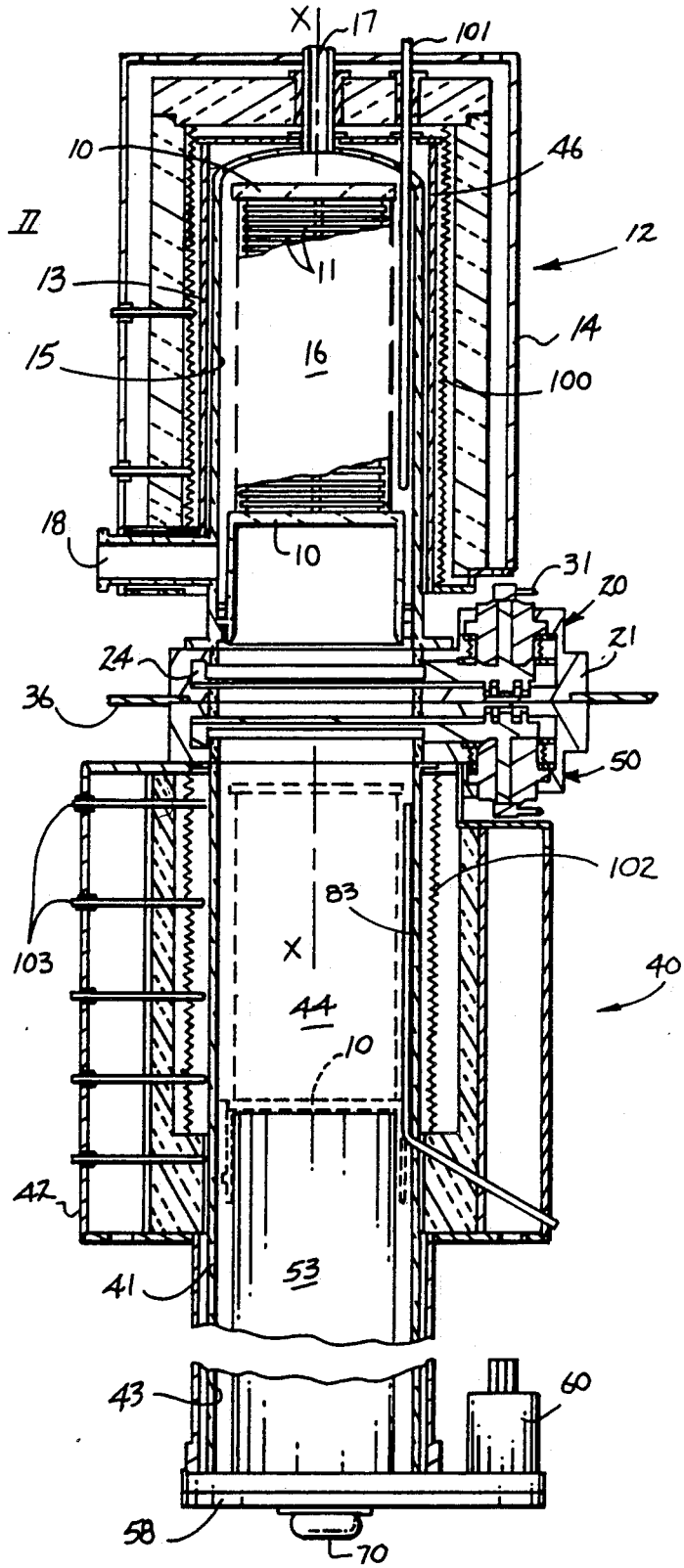
FIG. 1 is an illustrative vertical sectional view taken through an aligned process chamber and load lock constructed and operating according to this disclosure.
FIG. 2 illustrates the spatial arrangement of FIGS. 2A and 2B.
FIG. 2A is the upper portion of an enlarged vertical elevational view taken through the process chamber and an upper section of an aligned load lock.
FIG. 2B is the lower portion of an enlarged vertical elevational view taken through the process chamber and an upper section of an aligned load lock.
FIG. 3 illustrates the spatial arrangement of FIGS. 3A and 3B.
FIG. 3A is the upper portion of a sectional view taken through the lower section of a load lock.
FIG. 3B is the lower portion of a sectional view taken through the lower section of a load lock.
Figure 2A:
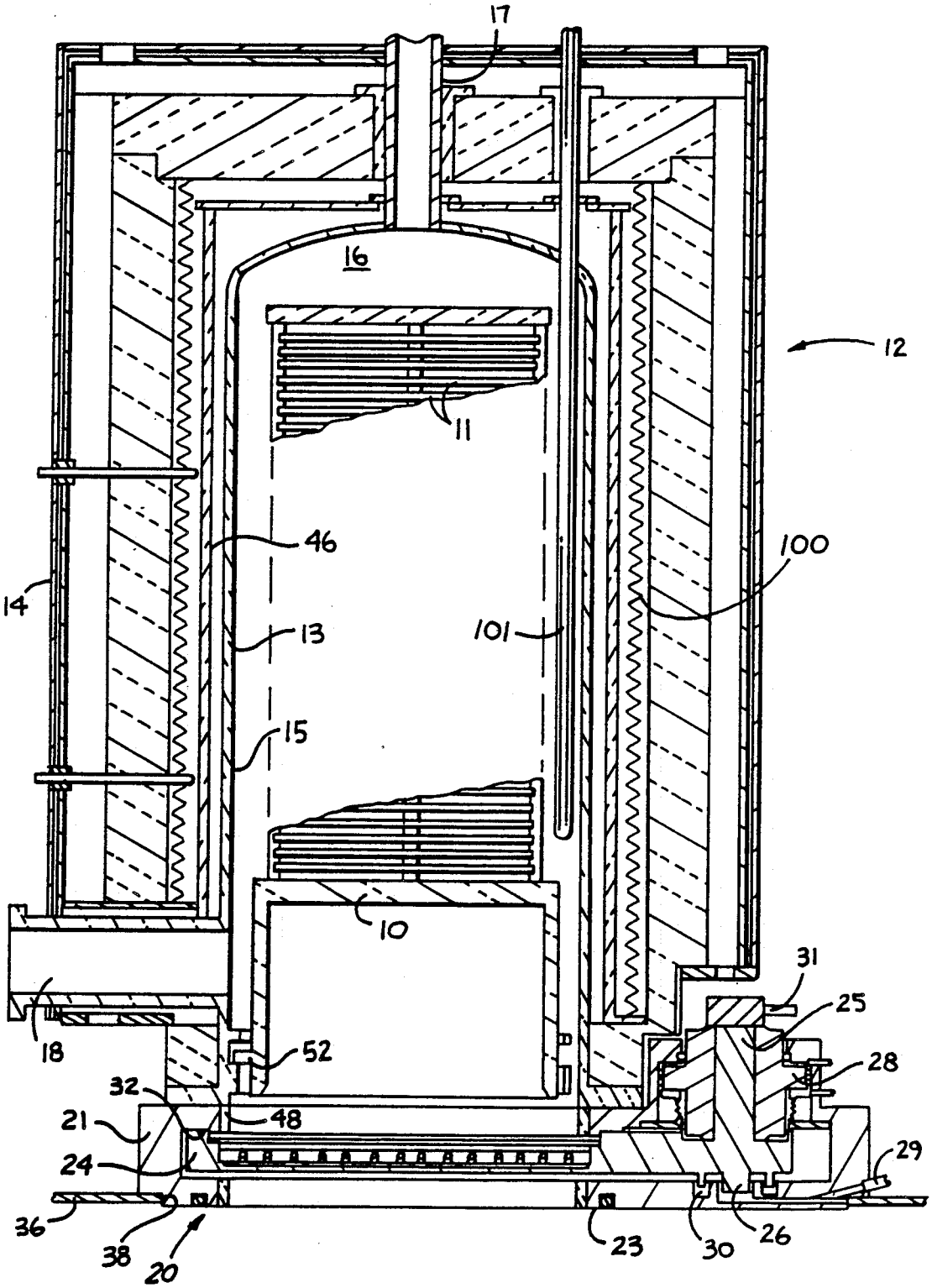
Figure 2B:
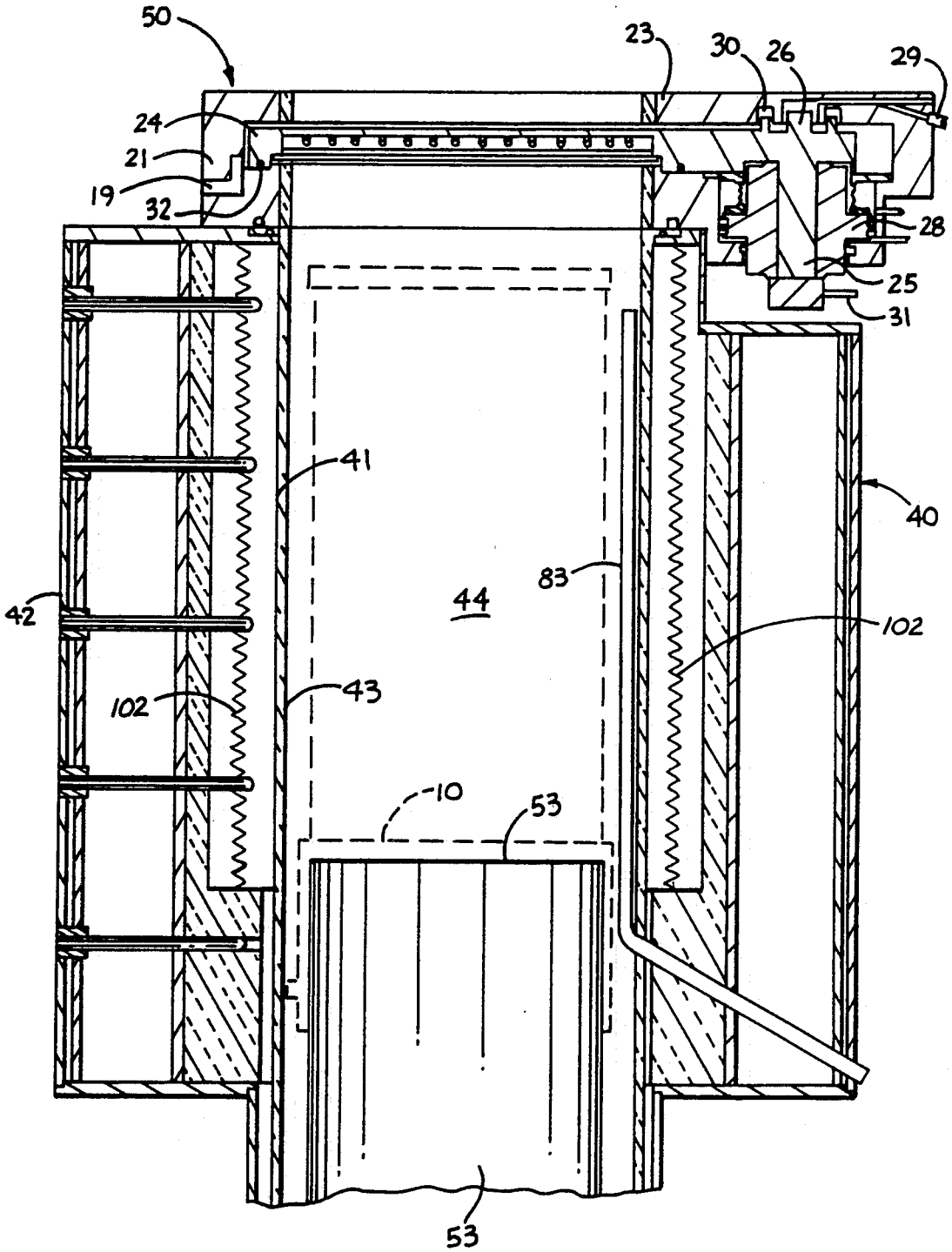
Figure 3A:
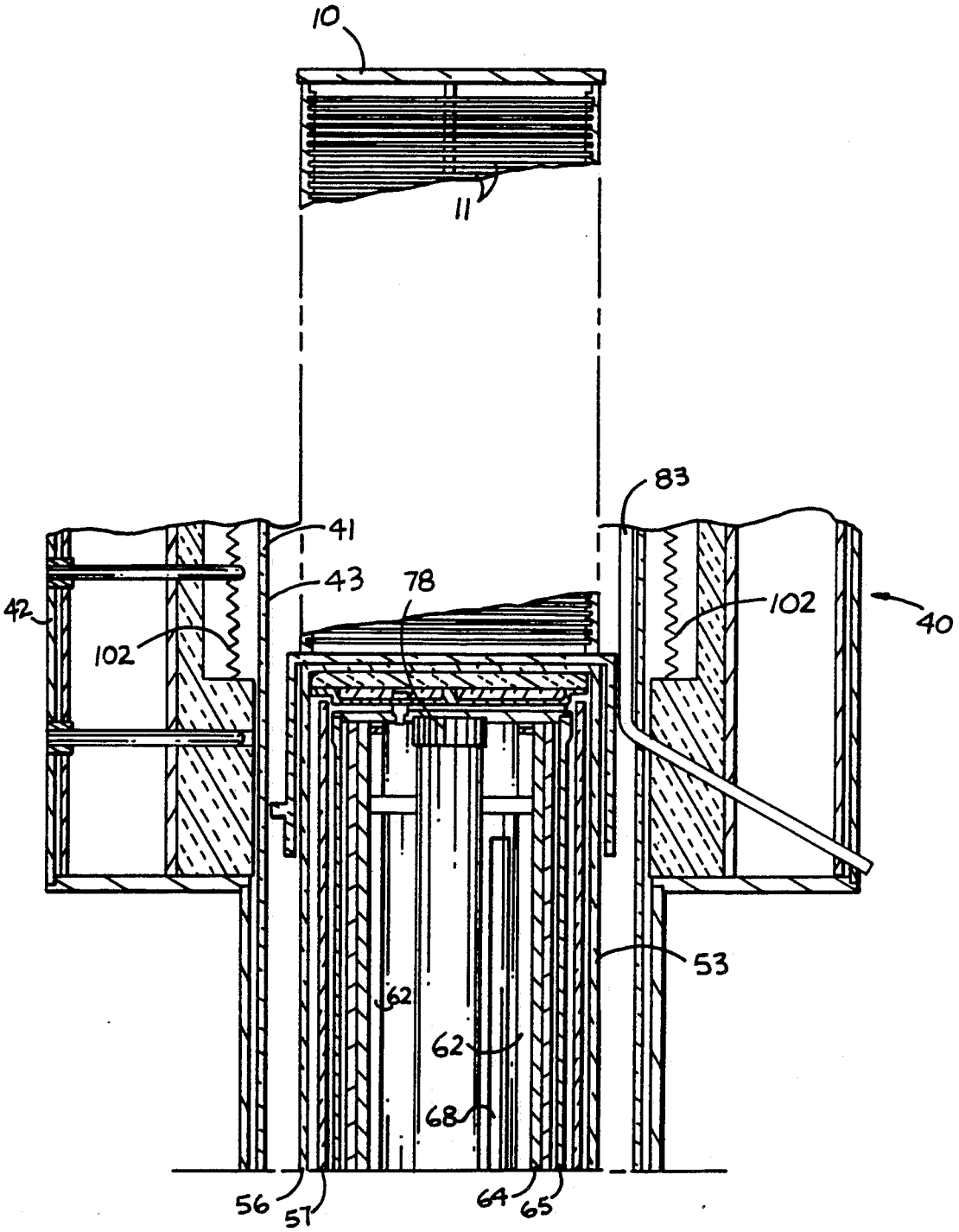
Figure 3B:
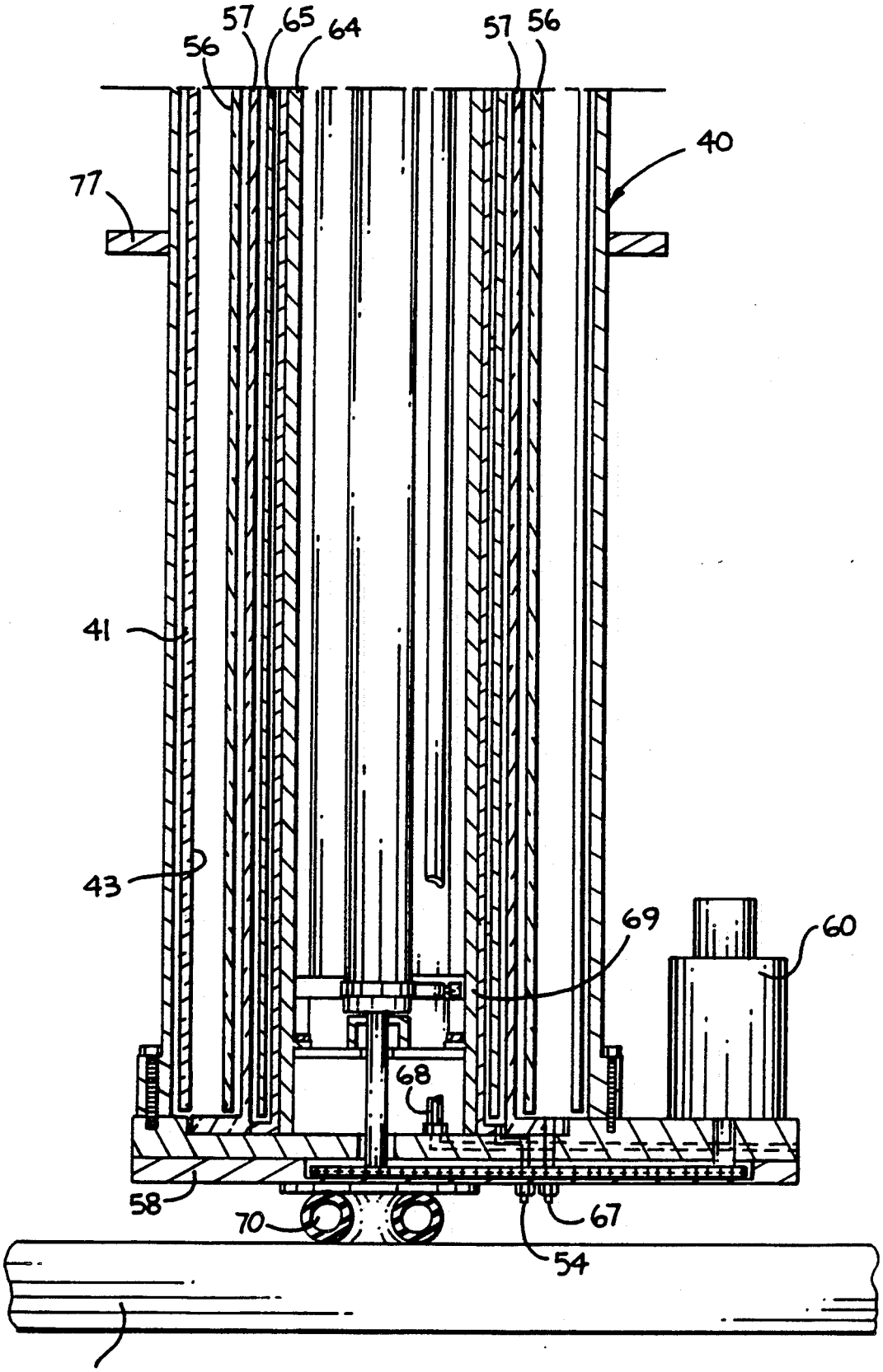

The following disclosure of the invention is submitted in compliance with the constitutional purpose of the Patent Laws "to promote the progress of science and useful arts" (Article 1, Section 8).

The general features of the thermal processor can be described by reference to the vertical elevational view shown in FIG. 1. This drawing illustrates the operative elements of the thermal processor during treatment of a plurality of stacked semiconductor wafers 11 supported within a vertical wafer boat 10. Boat 10 supports the stack of wafers 11 in parallel horizontal positions with the wafer surfaces exposed and spaced from one another.

The wafer boat 10 is located within the interior space 16 of a process chamber 12 during wafer treatment procedures. Process chamber 12 is lined by a process tube 13 having the general form of a bell jar. Its inner cylindrical surface 15 defines an interior space 16 configured in size and shape to environmentally isolate the stack of wafers 11 during treatment. The exterior of process chamber 12 is defined by a cylindrical canister 14.

The open supporting framework that supports the thermal processor is generally shown in the drawings at 37 (See FIGS. 4–7). Both the process tube 13 and the canister 14 of process chamber 12 are shown coaxially centered along a vertical process chamber axis X—X on framework 37. This illustrated position is the normal fixed operational position of the process chamber 12 on the supporting framework 37. The process chamber 12 is stationary during use.

Process chamber 12 has a gated opening formed at its lower end, through which wafer boats 10 can pass when moving to and from its interior space 16. The open lower end of process tube 13 rests on a first gate valve assembly 20 that serves as its gated opening. The gated opening formed by gate valve assembly 20 is in communication with the interior space 16 of process chamber 12.

A load lock 40 is shown in FIG. 1 in a coaxial position with the process chamber 12. Wafers are maintained in load lock 40 during preheating (prior to treatment) and cooling (subsequent to treatment).

Load lock 40 includes an interior space 44 located within the upper axial section of a cylindrical quartz liner tube 41. The interior space 44 is also configured in size and shape for environmentally isolating a stack of wafers 11 supported within a wafer tower 10. The interior space 44 is bounded by the inner surface 43 of liner tube 41. A spaced cylindrical canister 42 encases the load lock 40.

The upper end of load lock 40 has a gated opening in communication with the interior space 44 of load lock 40. The gated opening is formed by a second gate valve assembly 50, which is essentially an inverted version of gate valve assembly 20. Gate valve assembly 50 can form a seal against the gate valve assembly 20 and permits passage of a stack of wafers 11 to and from the interior space 44 of load lock 40.

Figure 12:
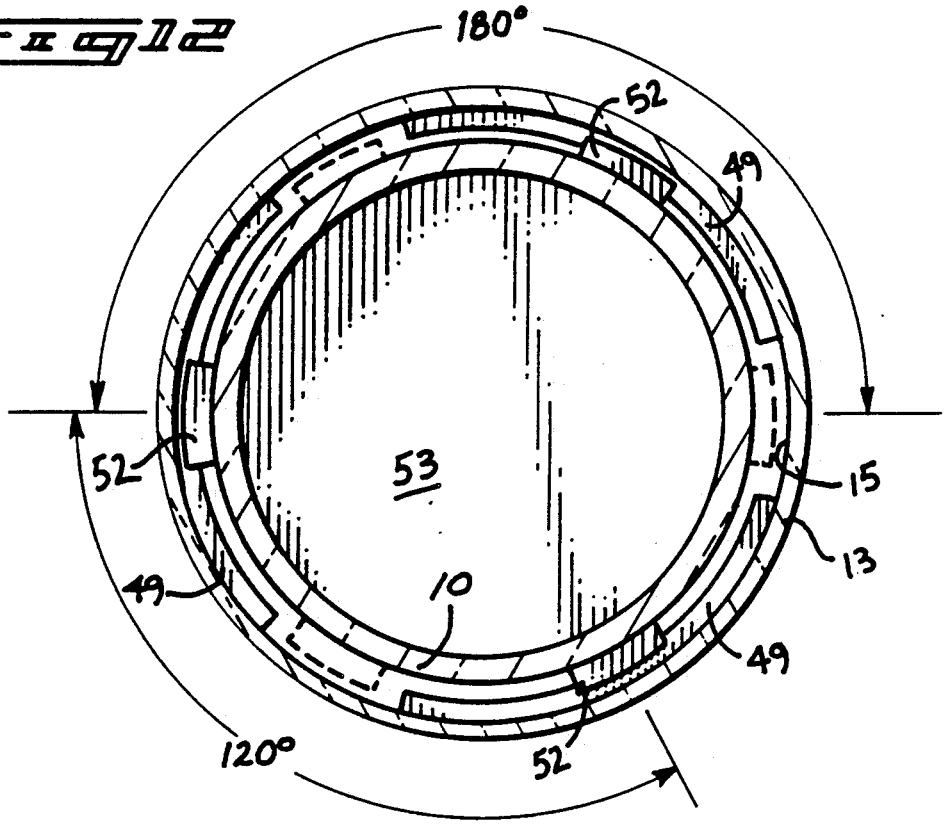
FIG. 12 is a sectional view taken along line 12—12 in FIG. 11.
Figure 11:
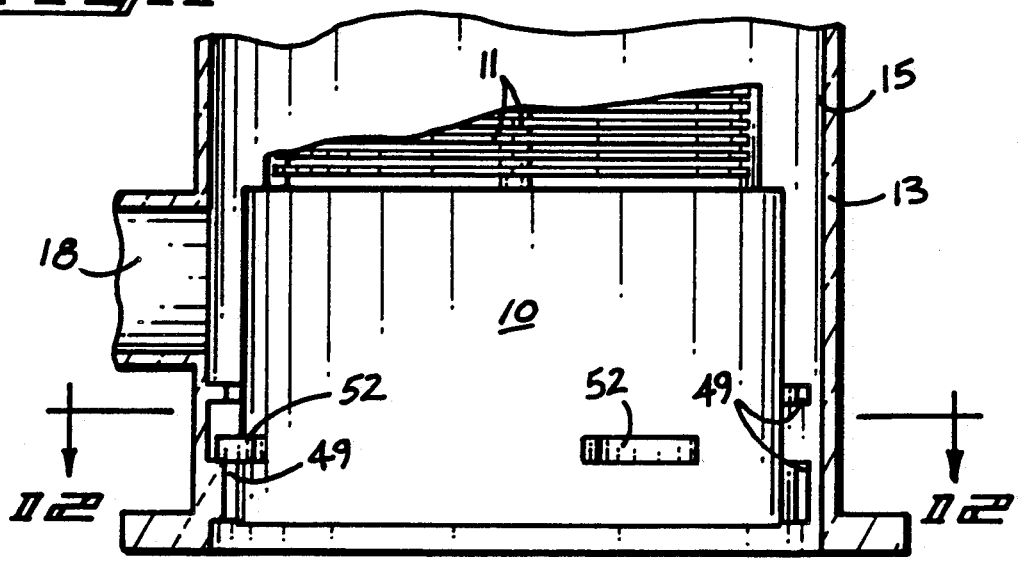
FIG. 11 is an enlarged fragmentary view illustrating the supporting arrangement between a quartz wafer boat and the process tube within the process chamber.
Figure 13:
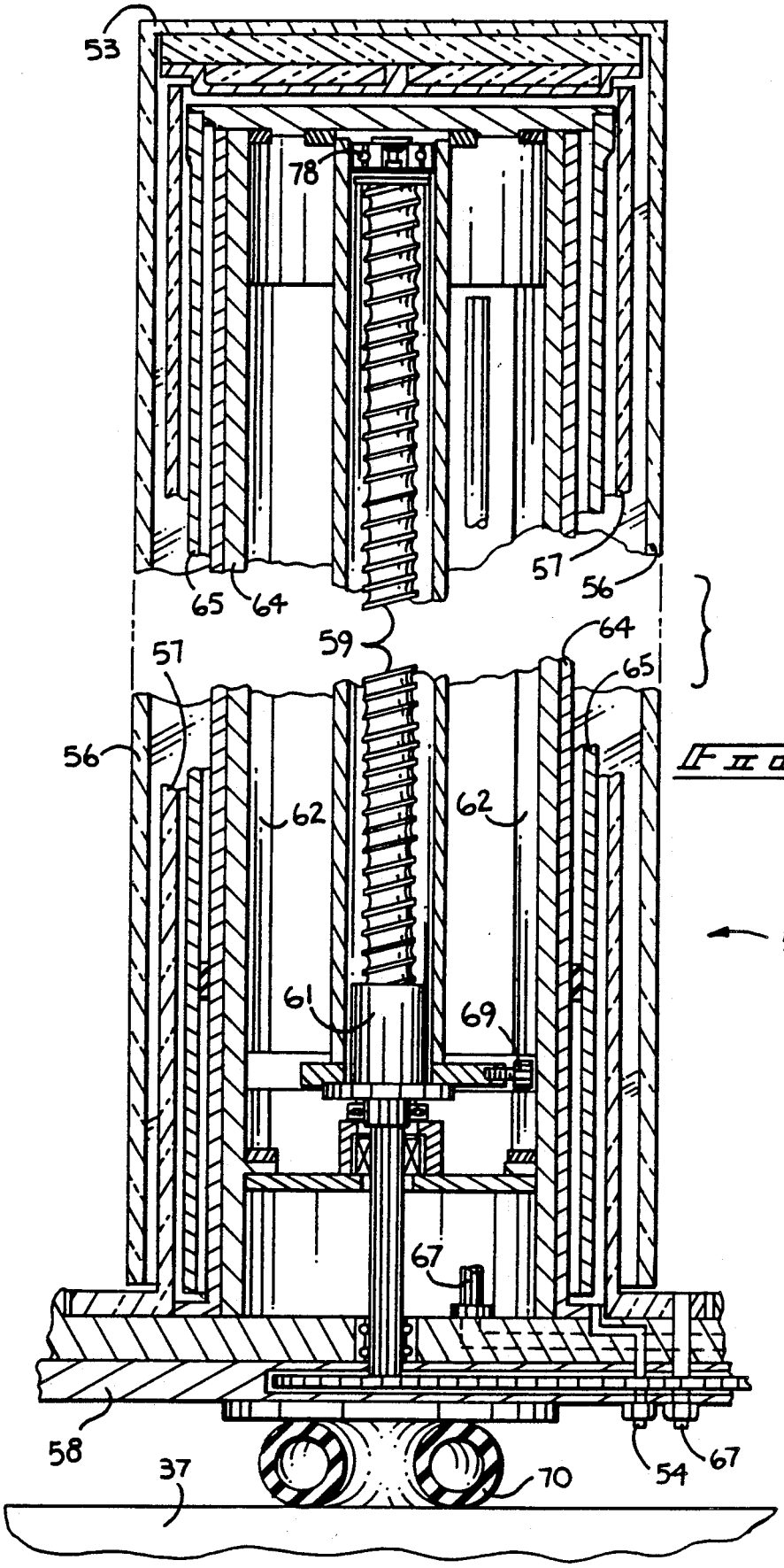
FIG. 13 is an enlarged sectional view of the upper and lower sections of the elevator assembly.

During treatment of wafers 11 within process chamber 12, a wafer boat 10 is releasably held within the interior space 16 by support means independent of the load lock 40. Each wafer boat 10 includes protruding radial lugs 52 that can engage process tube 13 to elevationally support the wafers 11 in fixed positions within the interior space 16 of process chamber 12 (See FIGS. 11 and 12). The fixed position of wafer boat 10 and wafers 11 within process chamber 12 is shown in full lines at the top of FIG. 1.

The thermal processor includes reciprocating means for selectively shifting a stack of wafers 11 through the gated openings of load lock 40 and process chamber 12 as they move between the interior spaces 44 and 16. This reciprocating means is illustrated in the drawings as an axially movable elevator 53 within load lock 40 (See FIG. 3). Elevator 53 can releasably support a wafer boat 10 so as to axially transfer it between the interior space 16 of process chamber 12 and the interior space 44 of load lock 40. When retracted, elevator 53 is located in the lower axial section of liner tube 41. The positions of a stack of wafers and their supporting quartz wafer boat 10 within interior space 44 are shown in dashed lines in FIG. 1.

The thermal processor includes gas supply connections to external gas sources (not shown) and vacuum pumps (not shown) for establishing selected environmental conditions within the interior spaces 16 and 44 of the process chamber 12 and load lock 40 independently of one another. This "atmospheric means" might include one or more vacuum pumps, pressure pumps and sources of inert gases, process gases and/or vapors required for pre-treatment, treatment, and/or post-treatment of wafers 11. These external devices, of conventional design, are well known in the design of semiconductor wafer treating systems and equipment.

A gas inlet 17 is provided at the top of process chamber 12. A gas outlet 18 is provided near its lower end. Vacuum outlets 67 are provided in communication with the lower end of load lock 40, along with an inlet 54 for a purging inert gas. Purging gas and/or vacuum pressure can also be directed into the spaces between and within the gate valve assemblies 20 and 50 through a gaseous inlet 19 included in gate valve assembly 50 (see FIG. 2B). These elements cooperatively provide the required gaseous conditions within process chamber 12 and load lock 40, as well as within the spaces that interconnect them for wafer transfer purposes.

The thermal processor includes "heat transfer means" for selectively establishing selected temperature conditions within the respective interior spaces 16 and 44 of the process chamber 12 and load lock 40 independently of one another.

The "heat transfer means" includes one or more electrical heating elements 100 surrounding process tube 13 between the process tube and its surrounding canister 14. Temperatures are monitored within process chamber 12 by a profile thermocouple located within a vertical sheath 101 extending within the interior space 16 and are monitored within the area of the heating elements 100 by a plurality of spike thermocouples positioned within horizontal sheaths shown at 104. The spike thermocouples protrude through the heating elements 100 to the space outwardly adjacent to the process tube 13. Temperature control within process chamber 12 is achieved by balancing the signals provided by the spike thermocouples at the exterior of liner 46 and those provided by the vertical profile thermocouple at its interior.

The outer skin of process chamber 12 is preferably constructed of a double-walled stainless steel jacket (see FIG. 2A) through which cooling liquid can circulate to maintain its dimensional stability regardless of the elevated temperatures within process chamber 12. The outside skin of the canister 14 is separated from the heating elements 100 by a surrounding open space that is ventilated about its periphery at both the upper and lower ends of process chamber 12. Either convection or forced air circulation can be used between canister 14 and the heating elements 100 to remove heat.

The heat transfer means also includes similar heating and temperature monitoring components in the load lock 40. As shown, one or more heating elements 102 surround its liner tube 41. A vertical sheath 83 is located within load lock 40 to hold a profile thermocouple that monitors the load lock interior temperature conditions. A plurality of spike thermocouples are also positioned in horizontal sheathes 103 extending between liner tube 41 and its surrounding double-walled canister 42 (see FIG. 2B) to monitor the temperature of the heating elements 102. Convection or forced air cooling is provided through a surrounding ventilated space between canister 42 and the heating elements 102. The double-walled canister 42 is also cooled by circulating fluid to assure its external dimensional stability.

Additional heating is provided within the movable flappers 24 of each gate valve assembly 20 and 50, as will be described below. Heat can also be supplied within the interior of elevator 53 by additional electrical heating elements (not shown). Coolant can also be circulated through the flappers 24 of gate valve assemblies 20, 50 for localized temperature control.

Cooling of both process chamber 12 and load lock 40 is accomplished by controlling operation of the heating elements 100 and 102, with the interior heat being dissipated to the exterior of the equipment by convection.

It is well known that the heating and cooling of process equipment used in the semiconductor industry results in flaking of surface materials that have been previously deposited on the exposed interior surfaces of the equipment, which are typically composed of quartz. The above-described apparatus provides physical isolation for wafers while positioned in the interior space 44 within load lock 40, which can be sealed, evacuated and heated (or cooled) during pre-treatment (or post-treatment) of a stack of wafers. All heating and cooling of wafers 11 occurs within the controlled environment of load lock 40. The illustrated thermal processor isolates any contaminants that result from heating and cooling the wafers within the interior of load lock 40, which is subjected to vacuum pressure to assist in their removal. It minimizes contamination of the interior of process chamber 12 by maintaining it at constant elevated temperatures where such flaking of surface deposits is nonexistent or negligible. It also prevents atmospheric contamination within the confines of process chamber 12 because all entry or exit of wafers occurs through the pre-conditioned load lock 40. Since all transfers happen under vacuum conditions, the very existence of vacuum pressure within joined load lock 40 and process chamber 12 serves a verification of the seals that prevent external contamination from occurring.

The provision of a separable load lock 40 for heating and cooling wafers 11 permits the process chamber 12 to be maintained at a constant elevated temperature near or equal to the desired treatment temperature for the particular process to which the wafers are to be subjected. Temperature changes required for heating and cooling of wafers are confined within the environmentally isolated load lock 40. This also permits the interior space 16 within process chamber 12 to be operated in a temperature range above the minimum temperature at which thermal shock to the semiconductor wafers occurs.

By physically separating the heating and cooling required during pre-treatment (and post-treatment) of wafers 11, contamination of the exposed surfaces within the process chamber 12 is substantially reduced in comparison to conventional wafer treatment furnaces in which the wafers 11 are subjected to wide ranges of temperature. This separation of functions also increases production through the thermal processor, since separate batches of wafers can be heated or cooled while a batch of wafers is being processed.

Figure 4:
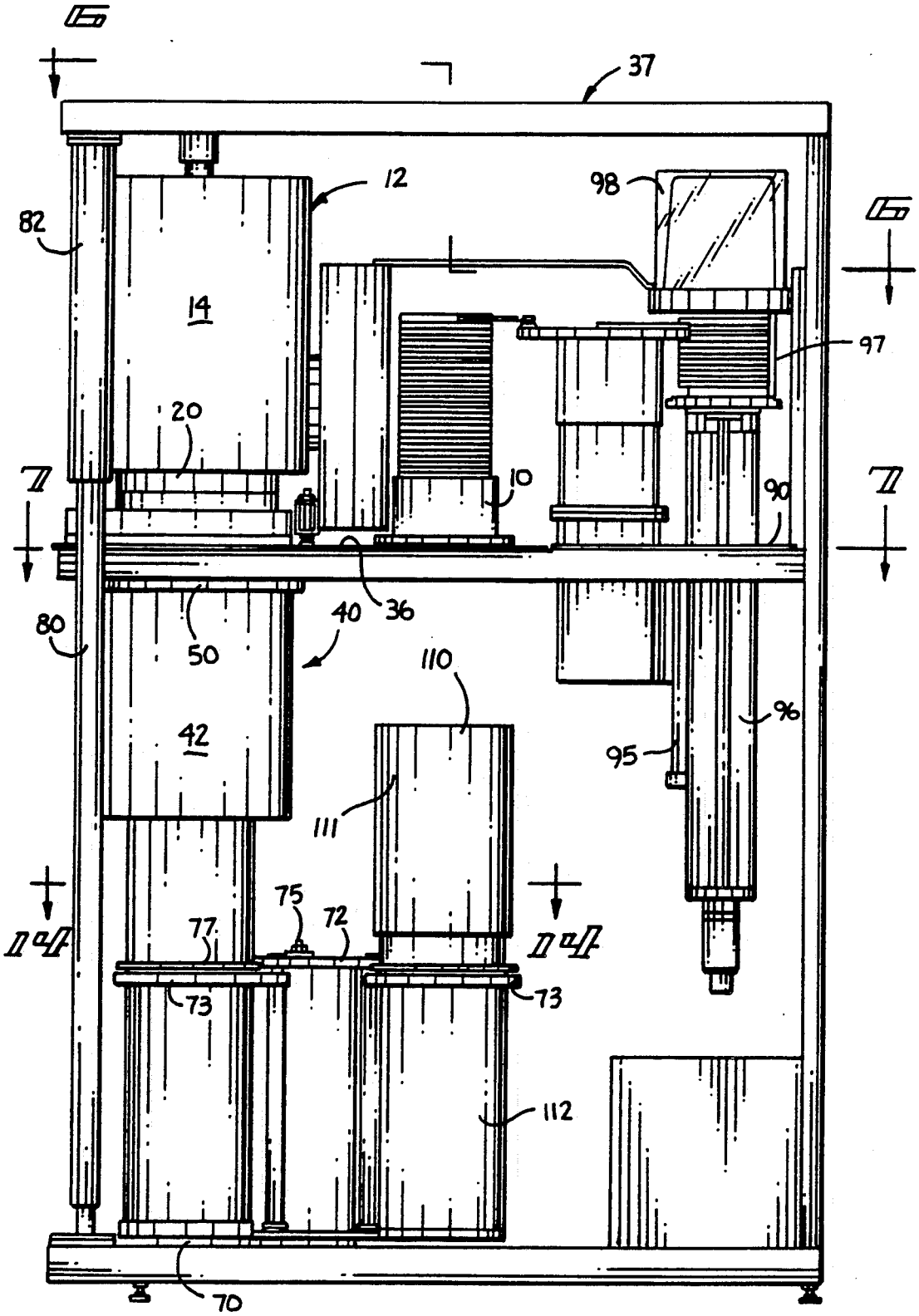
FIG. 4 is a vertical side view of the thermal processor.
Figure 5:
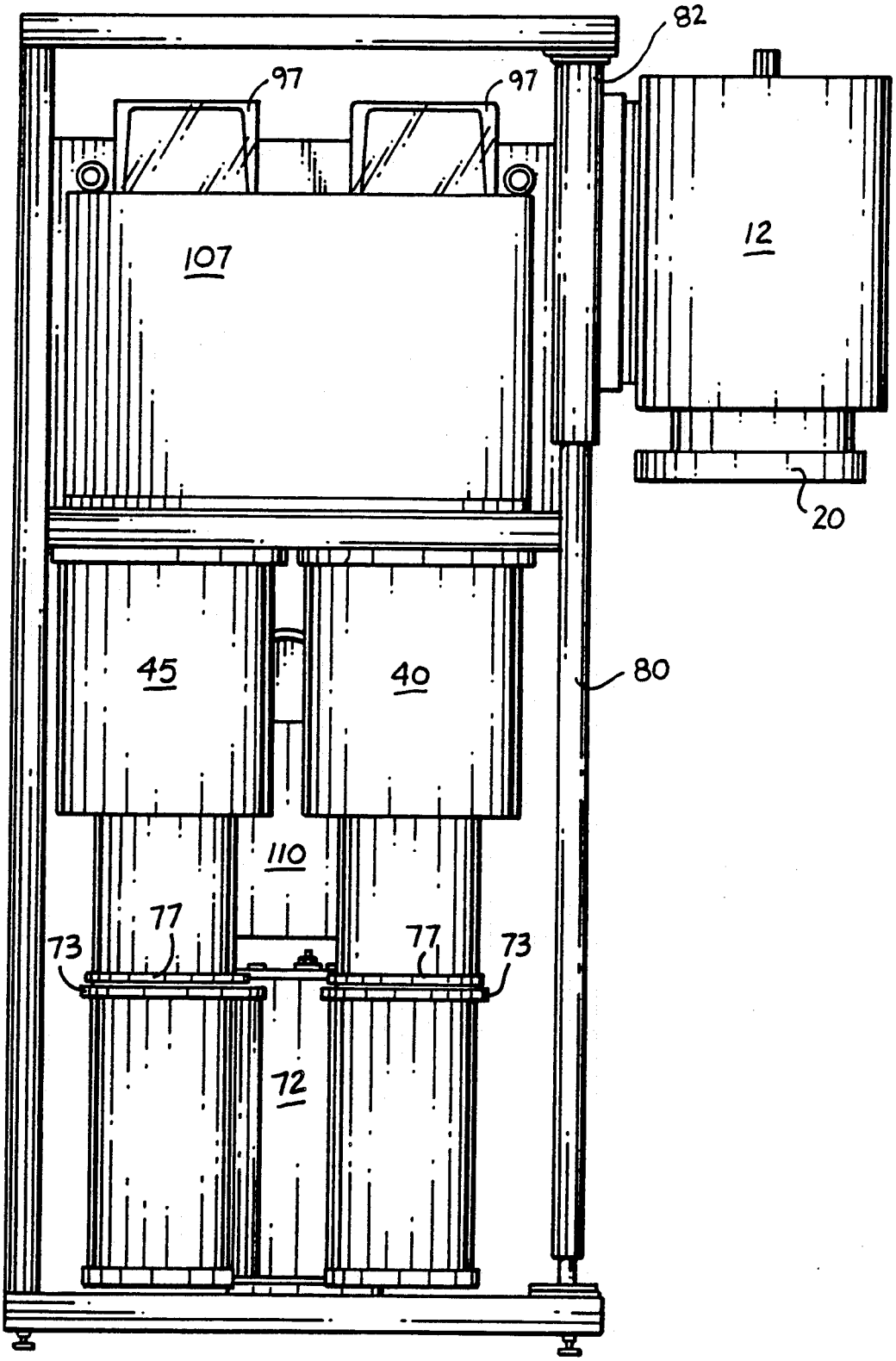
FIG. 5 is a rear view of the thermal processor.
Figure 10:
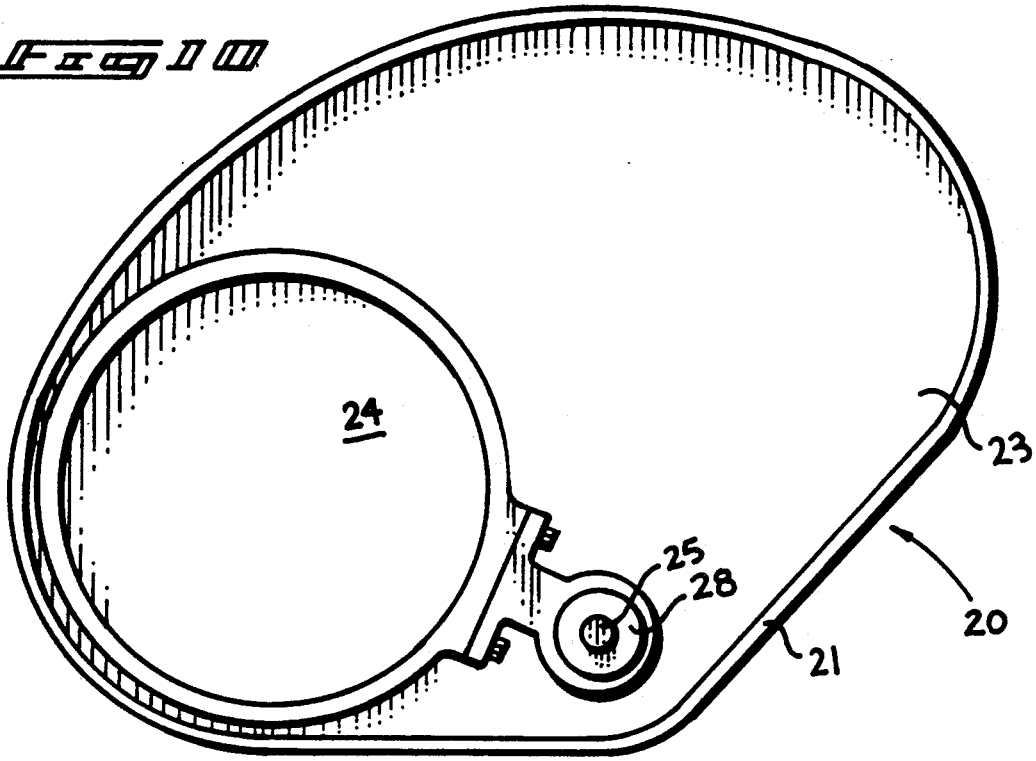
FIG. 10 is a sectional view through the gate valve assembly as seen along line 10—10 in FIG. 9.

As can be seen from FIGS. 4 and 5, the supporting framework 37 is divided into upper and lower sections by an intermediate horizontal deck 36. The process chamber 12 extends vertically upward from deck 36 and is fixed at the upper side of deck 36. The gated lower end of process chamber 12 is mounted within a kidney-shaped opening 38 formed through the deck 36. The deck opening 38 (FIG. 2A) is shaped and sized complementary to the exterior configuration of the gate valve housing 21 at the bottom of process chamber 12, which is seated within it.

The load lock 40 is mounted on the framework at an elevation below deck 36. In the preferred embodiment, there are two load locks, respectively designated by the reference numbers 40 and 45. Each load lock 40, 45 is movable between a first position coaxially engaged beneath the process chamber 12 and a second position that is laterally clear of it. They are identical to one another and can be used alternately for heating and cooling of wafers 11 during pre-treatment and post-treatment.

Figure 14:
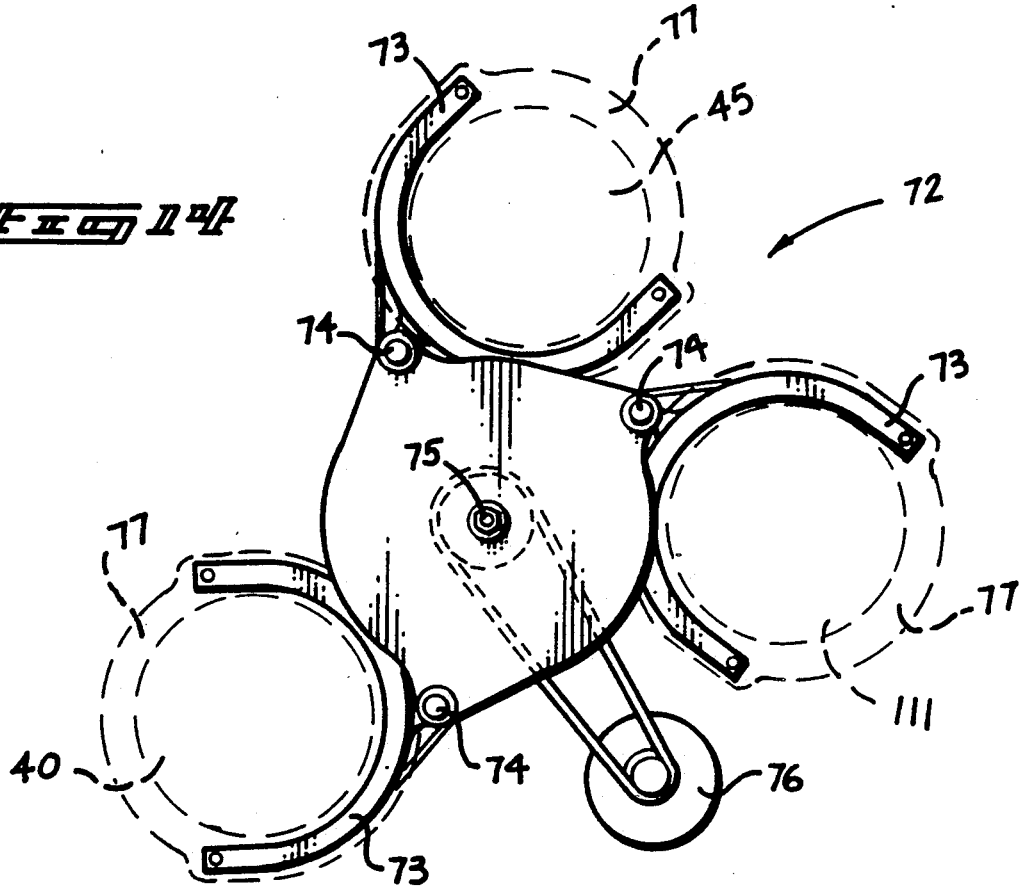
FIG. 14 is a top plan view of the supporting spider as viewed generally along line 14—14 in FIG. 4.

The two load locks 40 and 45 are independently supported on a spider 72 that operates as a transfer means for selectively moving a chosen load lock between the above-described first and second positions (see FIGS. 5, 7 and 14). The spider 72 is mounted on framework 37 about a vertical spider axis Y—Y displaced from the process chamber axis X—X. The two load locks 40 and 45 are movably supported by spider 72 at angularly spaced positions about the spider axis Y—Y.

In addition to the two load locks 40 and 45, spider 72 can also support process chamber cleaning means for selective insertion into the process chamber 12 when cleaning of its inner surfaces 15 is required. The cleaning means is shown as a plasma cleaning element 110 of conventional design, having a cylindrical shape complementary to the configuration of the interior space 16 within process chamber 12.

The plasma cleaning element 110 is mounted within a separate canister 111 and supported by an elevator 112. Canister 111 and elevator 112 are similar in structure to the previously described canister 42 and elevator 53.

The plasma cleaning element 110 is supported on spider 72 at a position angularly spaced from the load locks 40 and 45. It is movable about the spider axis Y—Y with the spider means between a first position coaxial with the process chamber axis X—X while aligned beneath the process chamber 12 and a second position that is laterally clear of it.

Docking means is operably connected between process chamber 12 and a coaxial load lock 40 or 45 for selectively effecting a releasable seal between their respective gated lower and upper ends. The docking means is illustrated as an inflatable air bag 70 at the bottom of framework 37 (FIG. 3B). The air bag 70 engages the bottom end of canister 42 to raise or lower a selected load lock relative to the fixed process chamber.

A horizontal loading deck 90 is also fixed across framework 37 at a location transversely adjacent to the deck 36. Loading deck 90 is provided with a circular aperture 91 formed through it. Aperture 91 is sized to permit vertical passage of a wafer boat 10. It is radially centered relative to the spider axis Y—Y by a distance identical to the separation between the centers of load locks 40 and 45 and axis Y—Y.

In the illustrated embodiment, the load locks 40, 45 and plasma cleaning element 110 are not equiangularly spaced about the spider axis Y—Y. Their unequal angular positions accommodate the kidney shape of the two gate valve assemblies 50, which are mounted to load locks 40 and 45 in reversed positions (See FIG. 7).

A robotic wafer handling station is arranged about the deck 90. It utilizes existing automated wafer handling equipment to stack and unstack the wafers 11 at a location vertically above aperture 91. Since each load lock 40 and 45 functions totally independent of the other, one load lock 40 or 45 can be loaded or unloaded through the aperture 91 while a separate load of wafers 11 are being treated in process chamber 12, or during pre-treatment or post-treatment of wafers 11 in the remaining load lock.

The details of the wafer handling station are not essential to an understanding of the present invention. It can utilize available robotic equipment programmed to automatically load and unload the wafers 11 in wafer boats 10 prior to and following their treatment within process chamber 12.

As each wafer boat 10 is being loaded or unloaded, it is independently supported on the loading deck 90 by a pin ring (not shown) having a plurality of radial pins that can be extended or retracted under a wafer boat positioned by an elevator 53 in a load lock 40. This frees the load locks for other operations while procedures relating to the loading or unloading of the wafer boats 10 are being carried out.

In general, the wafer handling station includes a pivotable robotic wafer engaging apparatus 93 having an extensible transfer arm 94. The robotic wafer engaging apparatus 93 is elevationally adjustable by operation of a supporting elevator 95.

Two elevators 96 are provided on framework 37 beneath the loading deck 90 to support wafer transfer cassettes 97. During loading and unloading operations, the stacked wafers 11 within cassettes are held at an elevated position above loading deck 90 and are exposed for engagement by the robotic loading apparatus 93. Process control wafers and/or dummy wafers can be supplied to the robotic apparatus 93 from supply stacks 108 and 109 located on the deck 90. The supply stacks 108 and 109 can be periodically replenished by use of cassettes 97.

A horizontal laminar flow of filtered air is supplied across the elevated wafers and cassettes 97 by blowers (not shown) through a transverse filter 87 and oppositely facing air return plenums 107 that span the loading and unloading area above deck 90. The horizontal laminar flow assures maximum air change across the parallel wafer surfaces to minimize turbulence and creation of boundary layers.

The control and operation of such robotic loading equipment is well known in the semiconductor wafer industry. Further details of these components is not believed to be necessary for an understanding of the present disclosure.

Turning now to the details of the apparatus, as illustrated in the accompanying drawings, the process chamber 12 is constructed as a double-walled interior structure comprising the process tube 13 and an adjacent cylindrical liner 46. The liner 46 is capped at its upper end and sealed about the protruding gas inlet 17 and thermocouple 101 that extend into the process tube 13. The bottom circular edge of process tube 13 has an outwardly protruding radial shoulder that seals against the upper surface of the upper gate valve assembly 20. Its inner surface includes partial horizontal ledges 49 that interlock with complementary lugs on the wafer boats 10 to hold wafers 11 stationary within process chamber 12.

The components of the process chamber 12 must be constructed of materials capable of withstanding the heat and environmental conditions to which they will be subjected during its operation. This typically will require that those components directly exposed to the operational environment along with the wafers 11 be constructed of quartz. This includes wafer boats 10, the process tube 13, and the inwardly facing surfaces of gate valve assembly 20 and flapper 24. The liner 46 is also preferably made of quartz, while canister 14 is constructed of a suitable metal, such as stainless steel. It is to be understood that the choice of these materials will vary, depending upon specific application requirements and that other high temperature materials, such as ceramics and silicon carbide, can be utilized where appropriate. Similar material selection considerations apply equally to the corresponding components of the load locks 40 and 45.

Process chamber 12 is stationary and bolted to deck 36 during normal operation of the thermal processor (see FIG. 5). It can be unbolted and swung laterally from its usual operational position on framework 37 by use of a swing pole 80 located adjacent to it. The exterior canister 14 of process chamber 12 is pivotally connected to swing pole 80 by a hinge bearing 82. A coaxial lifting screw assembly is powered within swing pole 80 and is operatively connected to the hinge bearing 82 for selectively lifting bearing 82 and process chamber 12 relative to the framework 37.

Following the lifting movement of the process chamber 12 (and attached gate valve assembly 20), these components can be manually pivoted about the vertical axis of swing pole 80 to a position outwardly alongside the supporting framework 37. The process chamber 12 and gate valve assembly 20 can then be lowered onto a receiving platform or vehicle (not shown) to support its weight, permitting canister 14 to be separated from the remainder of process chamber 12. Removal of process chamber 12 facilitates maintenance or replacement of liner 46 and process tube 13 when such procedures are required.

The gate valve assembly for process chamber 12 interlocks with the deck 36 on framework 37. The lower surface of its outer wall 23 has a peripheral groove formed about it, which is received within the complementary kidney-shaped opening 38. The valve housing 21 can be selectively fixed to deck 36 by a series of peripheral bolts attached between them.

The details of gate valve assembly 20 are best seen in FIGS. 8 and 9. It is encased within a valve housing 21 having a kidney shape when viewed in a horizontal plane. It includes an interior cavity bounded by a pair of spaced parallel upper and lower walls, the inner wall being indicated in the drawings by reference numeral 22 and the outer wall being indicated by reference numeral 23. The pair of walls 22, 23 have aligned apertures formed through them to permit passage of a stack of wafers. The circular aperture formed through the inner wall 22 is selectively enclosed by pivoted valve flapper 24. The valve flapper 24 is located within the cavity of the valve housing 21. It is supported by an offset shaft 25 integral with the structure of flapper 24.

The flapper support arrangement operably connected between the valve housing 21 and the valve flapper 24 permits selective motion of the flapper 24 between a closed position overlapping the aperture formed through the upper wall structure 22 and an open position laterally clear of the aperture.

Valve flapper 24 seals within a peripheral groove formed about the aligned opening through the upper wall structure 22. Axial movement of the valve flapper 24 is required in order to clear groove 32 so that the valve flapper 24 can swing angularly about the axis of its supporting shaft 25. The illustrated assembly permits such dual movement of flapper 24, while eliminating particle contamination due to the bearings and mechanisms required within the enclosed valve housings 21.

The axis of flapper 24 along shaft 25 is perpendicular to the parallel upper and lower walls 22, 23 of the valve housing 21. Axial movement is accomplished by operation of an axially movable piston 28 between shaft 25 and the upper wall structure 22. Piston 28 includes an intermediate shoulder that protrudes outwardly about its circumference. Pneumatic or hydraulic force can be applied to the piston 28 to shift it along the axis of shaft 25. The piston 28 and shaft 25 move axially in unison, but shaft 25 is free to pivot about its axis independently of the surrounding piston 28. The piston 28 and shaft 25 are provided with suitable bearings to facilitate the required movement of flapper 24 within the valve housing 21.

Piston 28 serves as a first power means operably connected to shaft 25 shift the valve flapper 24 relative to the valve housing 21 in an axial direction parallel to the axis of shaft 25.

A crank arm 31 is fixed to the outer end of shaft 25. A second power means, shown as an extensible pneumatic or hydraulic cylinder assembly 33, is operably connected to shaft 25. Cylinder assembly 33 is connected between the exterior of valve housing 21 and the outer end of crank arm 31. It angularly pivots the valve flapper 24 relative to the valve housing 21 about the axis of shaft 25. Clevis joints are provided at the opposed ends of cylinder assembly 33 to accommodate the previously-described axial movement of shaft 25.

As can be seen in FIG. 2A, the lower end of shaft 25 is rotatably and axially guided within a loose sleeve bearing 26 formed in the lower wall 23 of valve housing 21. Bearing 26 is surrounded by a peripheral groove that receives a cylindrical labyrinth seal element 30. A vacuum line 29 extends into the bearing 26. By applying vacuum pressure to line 29, contaminants in the bearing area are drawn out from it. An additional port (not shown) provides reduced vacuum pressure within the space between the two valve flappers 24 while they are aligned and in their respective closed positions.

The gate valve assemblies 50 provided at the top of load locks 40 and 45 are essentially identical in detail with the gate valve assembly 20. They are inverted elevationally and arranged in reversed positions. For consistency, the numerals applied to gate valve assembly 20 also appear in the drawings with respect to the corresponding elements of gate valve assemblies 50.

The gate valve assemblies 20 and 50 have complementary outer surfaces on walls 23 which seal against one another while the respective bottom and top openings of the process chamber and a load lock are coaxial.

As previously described, the essential interior structure of load lock 40 is a cylindrical liner tube 41. It extends between the gate valve assembly 50, that seals against an outwardly projecting peripheral flange formed on liner tube 41, and the lower end of canister 42, which includes peripheral seals engaging about liner tube 41 at locations adjacent to base plate 58. Liner tube 41 is vertically suspended within a receiving groove at the top of canister 42, and can be readily lifted from the canister after removal of the covering gate valve assembly 50.

The purpose of elevator 53 in each load lock 40, 45 is to elevationally lift or lower a wafer boat 10 while transferring it into and out from the interior space 44 within the load lock. In addition, elevator 53 imparts angular movement to the wafer boat 10 about the vertical axis X—X at its extreme elevated position within interior space 16 in the process chamber 12. This rotational movement is used to interlock or release lugs 52 and the receiving horizontal ledges 49 at the inner surface of process tube 13.

The upper end of the elevator 53, which engages the interior of wafer boat 10, is formed as an outer labyrinth tube 56. It telescopically receives and partially covers a slightly smaller cylindrical inner labyrinth tube 57 fixed to base plate 58. Both tubes 56 and 57 are preferably made of quartz or another high temperature inert material. The telescoping labyrinth tubes 56, 57 provide a protective inert covering about the adjustable elevator structure as it expands or contracts vertically within the load lock 40.

The elevator 53 includes a pair of guide tracks 62 that extend in a vertical direction along the inside of a fixed inner elevator guide tube 64. The illustrated guide tracks 62 are shown diametrically opposite from one another across the center of elevator guide tubes 64 and 65. A telescoping outer guide tube 65, provided with slidable bearing supports about the guide tube 64, moves elevationally in unison with the elevator 53.

The interior of elevator 53 is subjected to vacuum pressure to evacuate particles within it through a vertical tube 68 in communication with a vacuum pump (not shown) through base plate 58. A supply of purging inert gas, such as nitrogen, can be provided through gaseous inlet 54 at a location radially positioned between the tubes 56, 57 and the metallic elevator guide tubes 64, 65. The inert gas will flow upwardly within tube 57 and downwardly along its outer surface before being drawn to the exterior of the elevator through the illustrated vacuum outlet 67. The resulting cover of inert gas prevents damage to the metal elevator elements that might otherwise be caused by the existence of corrosive vapors and particles in the space surrounding the elevator mechanism.

Elevator 53 is powered by a motor 60 fixed adjacent to base plate 58. The vertical shaft of motor 60 is coupled to an elongated vertical ball screw 59 threadably engaged by a ball nut 61 that travels vertically in response to screw rotation. Ball nut 61 is provided with a single cam follower 69 which rolls vertically along one of the two diametrically opposite guide tracks 62.

As it travels along the length of screw 59, the elevator 53 is restrained from rotating relative to the stationary elevator guide tube 64 by the rolling engagement of cam follower 69 within vertical track 62. However, when the ball nut 61 reaches the upper limits of its travel along ball screw 59, it will axially engage both the inner and outer races of a horizontal bearing assembly 78 at the same time that cam follower 69 is released from the upper end of its track 62. Continued rotation of ball screw 59 by motor 60 will then cause the elevator 53 to rotate one half revolution in a horizontal plane, which will result in the lugs 52 on wafer boat 54 traversing the horizontal surfaces of the ledges 49.

After a half revolution of rotation has been imparted to the elevator 53, the direction of rotation of the ball screw 59 will be reversed by operation of motor 60. This will cause lugs 52 to rest on ledges 49 in a stationary position and fix the location of wafer boat 10 and wafers 11 within the process chamber 12. Subsequent downward movement of elevator 53 will release the elevator 53 from engagement with the wafer boat 10. Cam follower 69 will then move downwardly within the remaining track 62.

When re-engagement is desired between elevator 53 and a wafer boat 10 within the process chamber 12, the operational steps required of elevator 53 are simply reversed to raise and partially rotate the wafer boat 10, thus freeing its lugs 52 from the supporting ledges 49.

The details of indexing spider 72 can best be understood by reference to FIGS. 4 and 14. The spider shaft 75, which is rotatably carried on framework 37 about axis Y—Y, carries three yokes 73. Each yoke 73 is freely pivotable on spider 72 about a vertical yoke connection 74. This pivotal mount between the individual yokes 73 and spider 72 facilitates removal and replacement of the load locks 40, 45, as well as the canister 111 for plasma cleaning element 110. An indexing motor 76 on framework 37 is drivingly connected to spider shaft 75 to angularly locate the spider 72 about axis Y—Y.

The canisters 42 for each load lock 40, 45 and the canister 111 each include a peripheral mounting flange 77 which is bolted to its supporting yoke 73. During operational use of the thermal processor, each yoke 73 is held in a fixed angular position on spider 72 by releasable bolted connections.

The connection 74 between each yoke 73 and spider 72 also permits limited axial movement of the yokes in a vertical direction parallel to the spider axis Y—Y. Such movement is used to accommodate the lifting action of air bag 70, which moves a selected load lock into sealing engagement with process chamber 12. The method for treating a plurality of stacked semiconductor wafers 11 by use of this apparatus involves first establishing an isolated gaseous environment within the interior of a load lock 40 (or 45) containing a stack of wafers 11. This typically will require application of vacuum pressure, thereby drawing any loose contaminants within canister 42 to its lower end and exhausting such contaminants from the load lock 40 to prevent contact with the wafer surfaces. Purging gases can also be introduced into load lock 40 to control internal gaseous conditions.

While the wafers 11 within load lock 40 are maintained under at atmospheric or vacuum conditions, the temperature of the interior space 44 about the wafer boat 10 can be raised to a preselected temperature under controlled time conditions. This preselected temperature is preferably the process treatment temperature to which the wafers 11 will be subjected within the interior space 16 of process chamber 12. Temperature variations along the stack of wafers 11 can be effectively monitored by the profile thermocouple within sheath 101.

Where the required process chamber temperatures exceed the capability of the heating system provided within the load lock, the preheat temperature within load lock 40 should be selected to prevent or minimize subsequent flaking and release of deposited materials at the inner surfaces 15 of process tube 13. This will require that the load lock be heated to a minimum temperature dependent upon the particular process and materials involved.

The sealed load lock 40 can be used to preheat a stack of wafers 11 while located at any angular position about spider axis Y—Y. It need not be kept axially aligned under process chamber 12.

Transfer of a wafer boat 10 between load lock 40 and the heated process chamber 12 is initiated by attaching the movable load lock to the heated process chamber 12. This is accomplished by expanding air bag 70 directly under the coaxial load lock.

After the load lock 40 has been attached to the heated process chamber 12 through their respective gate valve assemblies, both must be adjusted to the same vacuum pressure conditions to assure a pressure balance between them. Their respective gated openings can then be opened to permit subsequent shifting of a stack of wafers into the interior of the process chamber 12.

Shifting of wafers between load lock 40 and process chamber 12 is accomplished by operation of elevator 53. The stack of wafers 11 is supported within the interior of process chamber 12 by lugs 52 that interconnect with process tube 13 to provide releasable support means for the wafers 11. After a stack of wafers 11 has been fixed within the interior space 16 of process chamber 12, elevator 53 can be retracted within the load lock and process chamber 12 can be sealed by closing its gate valve assembly 20.

Once the process chamber 12 is sealed, treatment operations can be carried out upon the wafers 11 within it independently of operations simultaneously occurring within the load locks. The load lock 40 can either remain coaxially beneath the process chamber 12 or be shifted angularly about the spider axis Y—Y. One can selectively program the operation of the apparatus to utilize the two available load locks in any convenient sequence for loading, unloading, pre-treatment and post-treatment of the stacked wafers 11.

The wafers 11 within process chamber 12 can be subjected to process gases or vapors as required for their treatment while the temperature of wafers 11 is either maintained at the temperature at which they were delivered into the interior space 16 of process chamber 12, or is further elevated, depending upon processing requirements.

At the completion of the processing steps, the temperature within the process chamber 12 is either maintained at a constant value, if attainable by the load lock, or reduced to the temperature within the receiving load lock. Process gases are then purged from the interior space 16 of process chamber 12 and replaced by inert gases at the termination of the processing procedures.

Having once again achieved a gaseous pressure balance between the interior space 16 of process chamber 12 and the interior space 44 of load lock 40, a passageway between them can then be opened by operation of gate valve assemblies 20 and 50. The stack of wafers 11 is then shifted into the interior space 44 of load lock 40 (or into the corresponding interior space of load lock 45) by operation of its elevator 53.

After removal of the wafers 11, both process chamber 12 and the load lock 40 can be promptly sealed by closing gate valve assemblies 20 and 50, respectively. By promptly closing gate valve assembly 20, a minimum quantity of heat will be dumped from the interior space 16 of process chamber 12, assuring the maintenance of a relatively constant interior temperature within the process chamber. Removal of the wafers 11 will not substantially cool the interior space 16 of process chamber 12, since heated gas will remain in the elevated interior of process chamber 12 and will not flow downwardly into the receiving load lock along with the lowered wafer tower 10.

While much of the commonly-encountered deposition of contaminants within the process tube 13 of process chamber 12 is eliminated by the present apparatus and method, the high degree of cleanliness required today for many thermoprocessing procedures makes it important to provide a method for readily cleaning the process tube surfaces. Such cleaning can be readily achieved by turning spider shaft 75 to axially align plasma cleaning element 110 under the process chamber 12. By opening gate valve assembly 20 and raising plasma cleaning element 110 into the interior space 16, cleaning of the inner surface 15 can be achieved with regularity at any desired sequence during the processing operations.

In compliance with the statute, the invention has been described in language more or less specific as to structural features. It is to be understood, however, that the invention is not limited to the specific features shown, since the means and construction herein disclosed comprise a preferred form of putting the invention into effect. The invention is, therefore, claimed in any of its forms or modifications within the proper scope of the appended claims appropriately interpreted in accordance with the doctrine of equivalents.

We claim:

1. A thermal processor for treating a plurality of horizontal semiconductor wafers arranged in a stack, comprising:

a framework;

a process chamber centered along a first axis on the framework, the process chamber having one open end leading to an interior space adapted to receive a stack of wafers;

first gate valve means mounted across the one end of the process chamber for selectively (1) sealing the process chamber and (2) opening the process chamber to provide access to its interior space;

a movable load lock on the framework adapted to be coaxially centered along the first axis, the load lock having one open end leading to an interior space adapted to receive one or more wafers;

second gate valve means mounted across the open end of the load lock for selectively (1) sealing the load lock and (2) opening the load lock to provide access to its interior space;

transfer means on the framework for selectively imparting relative movement between the process chamber and the load lock between a first position in which their respective open ends are coaxially engaged with one another and a second position in which their respective open ends are clear of one another;

reciprocating means mounted within the load lock for moving a stack of wafers between a first position located outward of the second gate means and a second position located within the interior space of the load lock;

atmospheric means for establishing selected gaseous and vapor conditions within the interior spaces of the process chamber and load lock independently of one another; and heat transfer means for selectively establishing selected temperature conditions within the respective interior spaces of the process chamber and load lock independently of one another.

2. The thermal processor of claim 1 further comprising:

complementary sealing means on the first and second gate valve means engageable with one another when the respective open ends of the process chamber and load lock are coaxial.

3. The thermal processor of claim 1 wherein the heat transfer means comprises:

first heating means arranged about the process chamber; and second heating means on the first gate valve means extending radially across the one open end of the process chamber when the process chamber is sealed.

4. The thermal processor of claim 1 wherein the heat transfer means comprises:

first heating means arranged about the load lock; and second heating means on the second gate valve means extending radially across the one open end of the load lock when the load lock is sealed.

5. The thermal processor of claim 1 wherein the heat transfer means comprises:

separate heating means and temperature monitoring means arranged about both the process chamber and the load lock for controlling the temperatures of their respective interior spaces independently of one another.

6. The thermal processor of claim 1 wherein the reciprocating means is enclosed by a first inert labyrinth member fixed to the load lock and a telescoping second inert labyrinth member movable in unison with the reciprocating means.

7. The thermal processor of claim 1 wherein the reciprocating means is enclosed by a first inert labyrinth member fixed to the load lock and a telescoping second inert labyrinth member movable in unison with the reciprocating means; and vacuum mean for exhausting gas both from within the reciprocating means and from a location outward of the first and second inert members.

8. A thermal processor for treating a plurality of horizontal semiconductor wafers arranged in a vertical stack, comprising:

vertical process chamber means, the process chamber means having an interior space configured to receive a stack of wafers for environmentally isolating them during wafer treatment, the process chamber means further having an opening at its lower end in open communication with its interior space, the opening being adapted to permit passage of a vertical stack of wafers to and from its interior space;

vertical load lock means, the load lock means having an interior space configured to receive a vertical stack of wafers for environmentally isolating them during preheating prior to wafer treatment and during cooling subsequent to wafer treatment, the load lock means further having an opening at its upper end in open communication with its interior space, the opening in the load lock means being adapted to permit vertical passage of a stack of wafers to and from its interior space;

transfer means operatively connected between the load lock means and process chamber means for selectively moving them relative to one another between a first position in which their respective openings are coaxial with one another and a second position in which the opening of the load lock means is clear of the opening of the process chamber means;

separate gate valve means positioned across the respective openings of the process chamber means and load lock means for independently sealing their interior spaces and for selectively establishing an open passageway between them through which a vertical stack of wafers can pass between them;

support means within the interior space of the process chamber for releasably holding a vertical stack of wafers;

reciprocating means in the load lock means for selectively shifting a vertical stack of wafers through the openings of the load lock means and process chamber means to and from their respective interior spaces;

atmospheric means for establishing selected gaseous and vapor conditions within the respective interior spaces of the process chamber means and load lock means independently of one another; and heat transfer means for selectively establishing selected temperature conditions within the respective interior spaces of the process chamber means and load lock means independently of one another.

9. The thermal processor of claim 8 wherein the gate valve means comprises:

a first gate valve fixed across the opening of the process chamber means;

a second gate valve fixed across the opening of the load lock means; and first and second independent valve operators respectively connected to the first and second gate valves for independently moving them between first conditions in which the interior spaces of the process chamber means and load lock means are sealed and second conditions in which open passageways are established through their openings.

the first and second gate valves having complementary outer surfaces adapted to seal against one another while the openings of the process chamber means and load lock means are coaxial with one another.

10. The thermal processor of claim 8 wherein the load lock means includes an inert wall having an upright cylindrical inner surface centered about a vertical axis, the inner surface being open at one axial end and being closed at its remaining axial end;

the gate valve means including a gate valve fixed across the one axial end of the inert wall structure.

11. The thermal processor of claim 8 wherein the transfer means is operably connected to the load lock means for further permitting vertical movement of the load lock means relative to the process chamber means; and actuating means for moving the load lock means in a vertical direction while in its first position to bring it into sealing engagement with the process chamber means.

12. A thermal processor for treating a stack of semiconductor wafers, comprising:

an upright framework having an intermediate horizontal deck surrounding an open deck aperture;

process chamber means mounted to the deck, the process chamber means being extended vertically upward from the deck and including a gated bottom end mounted in the deck aperture;

load lock means mounted on the framework at an elevation below the deck, the load lock means including a gated top end, the load lock means being movable relative to the framework between a first position coaxially aligned beneath the process chamber means and a second position transversely clear of the process chamber; and docking means operably engageable between the process chamber means and load lock means while the load lock means is in its first position for selectively effecting a releasable seal between their respective gated lower and upper ends.

13. The thermal processor of claim 12 further comprising:

robotic wafer loading means on the framework for stacking and unstacking wafers at an elevation above that of the load lock means.

14. The thermal processor of claim 12 wherein the load lock means further comprises:

elevator means for selectively moving a vertical stack of wafers between a raised position elevated above the load lock means and a lowered position retracted within the load lock means.

15. The thermal processor of claim 12, further comprising:

atmospheric means for establishing selected gaseous and vapor conditions within the interiors of the process chamber means and load lock means independently of one another; and heat transfer means for selectively establishing selected temperature conditions within the respective interiors of the process chamber means and load lock means independently of one another.

16. The thermal processor of claim 12, further comprising:

pivotal support means mounted about a vertical axis on the framework for shifting the load lock means between its first and second positions.

17. The thermal processor of claim 12, wherein the load lock means comprises at least two independently usable load lock assemblies, and further comprising:

spider means rotatably mounted about a vertical axis on the framework and movably supporting the two load lock assemblies at angularly spaced positions relative to the vertical axis for shifting the load lock assemblies between their first and second positions.

18. The thermal processor of claim 12, further comprising:

spider means mounted about a vertical axis on the framework for shifting the load lock means between its first and second positions; and process chamber cleaning means supported on the spider means at a position angularly spaced from the load lock means, the cleaning means being movable between a first position aligned beneath the process chamber means and a second position laterally clear of it.

19. The thermal processor of claim 12, further comprising:

spider means mounted about a vertical axis on the framework for shifting the load lock means between its first and second positions;

process chamber cleaning means supported on the spider means at a position angularly spaced from the load lock means, the cleaning means being movable between a first position aligned beneath the process chamber means and a second position laterally clear of it; and elevating means for vertically moving the process chamber cleaning means relative to the framework.

20. The thermal processor of claim 12, further comprising:

movable support means operably connected between the process chamber means and the framework for selectively shifting the process chamber means between a first position in which its gated end is receivable within the deck aperture and a second position horizontally clear of the deck.

21. The thermal processor of claim 12, further comprising;

a vertical swing pole on the framework adjacent to the process chamber;

lifting means operably connected between the swing pole and the process chamber for selectively moving the process chamber in a vertical direction relative to the framework; and pivot means connecting the lifting means about a vertical axis on the swing pole for permitting pivotal movement of the process chamber relative to the vertical axis for selectively moving the process chamber horizontally clear of the deck.

22. A method for treating a plurality of stacked semiconductor wafers, comprising:

establishing a preselected gaseous environment within the sealed interior of a movable load lock containing a stack of wafers;

heating the sealed interior of the load lock and the stack of wafers to a preselected charging temperature;

movably attaching the load lock to a heated process chamber;

shifting the wafers into the interior of the heated process chamber;

supporting the stack of wafers within the interior of the process chamber independently of the load lock;

sealing the interior of the process chamber from the interior of the load lock;

subjecting the stack of wafers within the process chamber to gas or vapor as required for their treatment;

opening a passageway between the interior of the process chamber and the interior of a load lock;

shifting the stack of wafers into the interior of the load lock;

sealing the interior of the load lock relative to the interior of the process chamber; and cooling the sealed interior of the load lock and the stack of wafers to a preselected discharge temperature.

23. The method of claim 22 further comprising the heated process chamber is maintained at a constant processing temperature.

24. The method of claim 22 wherein the process chamber is maintained at a constant processing temperature; and the preselected charging temperature to which the interior of the load lock is raised is identical to the processing temperature within the processing chamber.

25. The method of claim 22 wherein the steps of heating and cooling the sealed interior of the load lock and the wafers are carried out while the load lock is detached from the processing chamber.

26. The method of claim 22 wherein the step of movably attaching the load lock is carried out with the load lock vertically aligned beneath the process chamber.

27. The method of claim 22, comprising the following additional steps:

movably positioning the load lock at a station displaced from the processing chamber; and inserting or removing a stack of wafers relative to the interior of the load lock at the station and independently of operation of the processing chamber.

* * * * *